US010279496B2

(12) United States Patent
Hartman et al.

(10) Patent No.: US 10,279,496 B2
(45) Date of Patent: May 7, 2019

(54) POLYMER PACKAGING SYSTEMS AND METHODS

(71) Applicant: Cloud Packaging Solutions LLC, Des Plaines, IL (US)

(72) Inventors: Donn A. Hartman, Antioch, IL (US); Alexander J. Waterman, Oak Park, IL (US); Tony Loiacono, Schaumburg, IL (US); Donn Daniel Hartman, Hawthorn Woods, IL (US)

(73) Assignee: Cloud Packaging Solutions LLC, Des Plaines, IL (US)

( * ) Notice: Subject to any disclaimer, the term of this patent is extended or adjusted under 35 U.S.C. 154(b) by 0 days.

(21) Appl. No.: 14/670,286

(22) Filed: Mar. 26, 2015

(65) Prior Publication Data

US 2015/0197352 A1 Jul. 16, 2015

Related U.S. Application Data

(62) Division of application No. 14/380,343, filed as application No. PCT/US2013/027174 on Feb. 21, 2013, now Pat. No. 9,162,413.

(Continued)

(51) Int. Cl.
*B26D 1/40* (2006.01)
*B26D 7/10* (2006.01)

(Continued)

(52) U.S. Cl.
CPC ..... *B26D 1/405* (2013.01); *B26D 1/385* (2013.01); *B26D 7/10* (2013.01); *B65B 9/042* (2013.01);

(Continued)

(58) Field of Classification Search
CPC ..... B31B 1/14; B26D 1/385; B26D 1/405; B26D 7/10; B65B 9/042; B65B 57/02;

(Continued)

(56) References Cited

U.S. PATENT DOCUMENTS 3,049,084 A * 8/1962 Werner Knecht ..... A21C 5/04 425/241
3,125,039 A * 3/1964 Haug et al. ..... A21C 5/04 425/240

(Continued)

FOREIGN PATENT DOCUMENTS

DE 1411993 A1 2/1969
DE 102007015624 A1 10/2008

(Continued)

OTHER PUBLICATIONS

"U.S. Appl. No. 14/380,343, Restriction Requirement dated Feb. 5, 2015", 8 pgs.

(Continued)

*Primary Examiner* — Sameh Tawfik
(74) *Attorney, Agent, or Firm* — Leydig, Voit & Mayer, Ltd.

(57) ABSTRACT

A rotary knife assembly includes a rotatable core and a plurality of knife blades extending from the rotatable core. A heating element is coupled with the plurality of knife blades, and the heating element is configured to heat the knife blades. One or more package guides are interposed between each of the plurality of knife blades configured to engage along one or more deformable packages as the rotatable core is rotated. In another example, a discharge assembly includes a conveyor belt including inner and outer belt surfaces, and a plurality of belt rows extending along a belt length. A plurality of package spacing ridges each include outer engaging edges, and one package spacing ridge of the plurality is positioned between each of the (Continued)

plurality of belt rows. The outer belt surface is recessed from the outer engaging edges.

7 Claims, 10 Drawing Sheets

Related U.S. Application Data

(60) Provisional application No. 61/601,378, filed on Feb. 21, 2012.

(51) Int. Cl.

| | |
|---|---|
| ***B26D 1/38*** | (2006.01) |
| ***B65B 57/02*** | (2006.01) |
| ***B65B 61/08*** | (2006.01) |
| ***B65B 61/10*** | (2006.01) |
| ***B65B 9/04*** | (2006.01) |
| *B65B 1/02* | (2006.01) |
| *B65B 1/04* | (2006.01) |
| *B65B 3/02* | (2006.01) |
| *B65B 3/04* | (2006.01) |
| *B65B 41/12* | (2006.01) |
| *B65B 61/28* | (2006.01) |
| *B65B 47/02* | (2006.01) |

(52) U.S. Cl.
CPC ..... *B65B 57/02* (2013.01); *B65B 61/08* (2013.01); *B65B 61/10* (2013.01); *B65B 1/02* (2013.01); *B65B 1/04* (2013.01); *B65B 3/02* (2013.01); *B65B 3/04* (2013.01); *B65B 41/12* (2013.01); *B65B 47/02* (2013.01); *B65B 61/28* (2013.01); *B65B 2009/047* (2013.01); *B65B 2220/06* (2013.01)

(58) Field of Classification Search
CPC ..... B65B 61/08; B65B 61/10; B65B 1/02; B65B 1/04; B65B 3/02; B65B 3/04; B65B 41/12; B65B 47/02; B65B 61/28; B65B 2009/047; B65B 2220/06
USPC ..... 53/558; 493/186; 198/834, 385, 803.1
See application file for complete search history.

(56) References Cited

U.S. PATENT DOCUMENTS

| | | | | | |
|---|---|---|---|---|---|
| 3,184,895 | A * | 5/1965 | O'Connor | B65B 9/042 | 53/412 |
| 3,192,684 | A | 7/1965 | Iannucci | | |
| 3,217,878 | A * | 11/1965 | Rood, Jr. | D01B 1/02 | 198/635 |
| 3,315,438 | A | 4/1967 | Kostur | | |
| 3,353,329 | A * | 11/1967 | Cloud | B29C 51/22 | 53/453 |
| 3,381,445 | A * | 5/1968 | Vogt | B29C 51/10 | 118/DIG. 4 |
| 3,757,620 | A | 9/1973 | Cloud et al. | | |
| 3,882,994 | A * | 5/1975 | Mecks | B65G 47/1471 | 198/397.01 |
| 4,267,137 | A * | 5/1981 | Smith | B29C 43/222 | 264/113 |
| 4,404,879 | A * | 9/1983 | Frohwerk | B26D 1/62 | 53/133.8 |
| 4,645,476 | A * | 2/1987 | King | F16H 7/06 | 198/834 |
| 4,778,326 | A * | 10/1988 | Althouse | H01L 21/67132 | 206/471 |
| 4,782,729 | A * | 11/1988 | Mathot | B26D 3/22 | 83/342 |
| 5,040,670 | A * | 8/1991 | Mendoza | B65G 17/08 | 198/834 |
| 5,081,819 | A * | 1/1992 | Cloud | B65B 1/366 | 425/373 |
| 5,129,299 | A * | 7/1992 | Fischer | B26D 3/22 | 83/121 |
| 5,203,143 | A * | 4/1993 | Gutentag | B65B 15/04 | 206/460 |
| 5,222,422 | A * | 6/1993 | Benner, Jr. | B26D 7/01 | 83/152 |
| 5,415,280 | A * | 5/1995 | Balboni | B65G 47/5136 | 198/347.3 |
| 5,477,655 | A * | 12/1995 | Hawley | B65B 35/405 | 53/251 |
| 5,648,136 | A * | 7/1997 | Bird | B65B 9/04 | 206/562 |
| 5,767,433 | A * | 6/1998 | Bill | F42B 33/00 | 206/3 |
| 6,241,374 | B1 * | 6/2001 | Konig | A21C 5/02 | 366/69 |
| 6,766,899 | B1 * | 7/2004 | Guldenfels | B65G 17/08 | 198/834 |
| 7,841,463 | B2 * | 11/2010 | DeGroot | B65G 15/42 | 198/832 |
| 8,136,827 | B2 * | 3/2012 | Lumpkin | F16H 55/171 | 198/834 |
| 8,662,880 | B2 * | 3/2014 | Fowler | B65B 9/042 | 264/554 |
| 9,162,413 | B2 | 10/2015 | Hartman et al. | | |
| 2005/0039417 | A1 * | 2/2005 | Liedtke | B65B 15/04 | 53/399 |
| 2010/0101392 | A1 | 4/2010 | Zeuschner | | |
| 2015/0065323 | A1 | 3/2015 | Hartman et al. | | |

FOREIGN PATENT DOCUMENTS

| | | | |
|---|---|---|---|
| FR | 1256759 | A | 3/1961 |
| WO | WO-2011061628 | A1 | 5/2011 |
| WO | WO-2013126596 | A1 | 8/2013 |

OTHER PUBLICATIONS

"International Application Serial No. PCT/US2013/027174, International Preliminary Report on Patentability dated Feb. 21, 2014", 5 pgs.
"International Application Serial No. PCT/US2013/027174, International Search Report dated Apr. 26, 2013", 3 pgs.
"International Application Serial No. PCT/US2013/027174, Written Opinion dated Apr. 26, 2013", 7 pgs.
U.S. Appl. No. 14/380,343, Ex Parte Quayle Action mailed Apr. 6, 2015, 7 pgs.
U.S. Appl. No. 14/380,343, Notice of Allowance dated Jun. 9, 2015, 9 pgs.
U.S. Appl. No. 14/380,343, Response filed Mar. 26, 2015 to Restriction Requirement dated Feb. 5, 2015, 7 pgs.
European Application Serial No. 13751786.8, Extended European Search Report dated Apr. 21, 2016, 10 pgs.
European Application Serial No. 13751786.8, Response filed Sep. 21, 2016 to Extended European Search Report dated Apr. 21, 2016, 19 pgs.
European Application Serial No. 17178051.3, Communication Pursuant to Article 94(3) EPC dated Aug. 10, 2017, 7 pgs.

* cited by examiner

POLYMER PACKAGING SYSTEMS AND METHODS

CLAIM OF PRIORITY

This patent application is a divisional of and claims the benefit of priority under 35 U.S.C. § 120 to U.S. patent application Ser. No. 14/380,343, entitled "POLYMER PACKAGING SYSTEMS AND METHODS", filed on Aug. 21, 2014, which is a U.S. National Stage Filing under 35 U.S.C. 371 from International Application No. PCT/US2013/027174, entitled "POLYMER PACKAGING SYSTEMS AND METHODS," filed on Feb. 21, 2013, and published as WO 2013/126596 A1 on Aug. 29, 2013, which claims the benefit of priority under 35 U.S.C. § 119(e) to U.S. Provisional Patent Application No. 61/601,378, entitled "POLYMER PACKAGING SYSTEMS AND METHODS," filed on Feb. 21, 2012, which are hereby incorporated by reference herein in their entireties.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Cloud Packaging Equipment, Des Plaines, Ill. All Rights Reserved.

TECHNICAL FIELD

This document pertains generally, but not by way of limitation, to packaging of powders, liquids, gases and the like.

BACKGROUND

Packaging systems are used to form deformable packages containing liquids, powders and the like. For instance, polyvinyl acetate (PVA) films are filled with powders or liquids and used in laundry, dishwashing, sanitizing and the like. These are single dose packages used in home clothes washers, dishwashers or used in hospitals, for instance in water buckets, for use in cleaning to sanitize surfaces as the water is applied to those surfaces. In one technique, the packages are formed on a rotating drum and separated into individual packages prior to delivery onto a conveyor belt.

OVERVIEW

The present inventors have recognized, among other things, that a problem to be solved can include separating packages with a heated knife blade while preventing the packages from undesirably engaging the heated knife blade a second time (e.g., before or after the separating operation). For instance, if the packages, after separation, are allowed to extend away from the forming drum (according to inherent elasticity in the film) the heated knife blade may engage the package and melt a portion of the package thereby spilling the contents of the package within a packaging system. Spilling the contents of the package within the packaging system may cause downtime and added labor to clean and reset the packaging system. By maintaining the packages within, for example, a respective cavity of the forming drum after separation, downtime and added labor can be minimized.

Additionally, another problem to be solved can include the removal of an elevated force or pressure to the packages, for instance an applied pressure from a conveyor belt or collision forces. Because films forming the packages are in one example in a heated condition after separation, the application of an elevated force to the packages can causes the edges of the heated packages to fray or warp thereby negatively affecting the aesthetic appearance of the packages. In an example, the elevated forces cause the packages to split along their seams and spill the contents of the package within the packaging system. In an example, if the packages are allowed to collide with each other, the packages may become adjoined as the packages cool while in contact with another package.

The present subject matter can provide a solution to these problems by providing an attenuated seating force to the plurality of packages. The attenuated seating force substantially maintains the packages within package cavities of the forming drum even after slitting and cutting of the packages. For example, a rotary knife assembly includes a plurality of knife blades extending from the rotatable core and one or more package guides interposed between each of the plurality of knife blades. Guide faces of the package guides engage along the one or more packages as the rotatable core is rotated thereby biasing the one or more packages away from the plurality of knife blades. The guide face is at a substantially decreased temperature relative to the knife blades and thereby ensures that the rotatory knife assembly does not undesirably apply heat to the surfaces of the separated packages that would otherwise cause damage to the package.

Additionally, the present subject matter provides a discharge assembly that biases the one or more deformable packages along the forming drum until a conveyor belt of the discharge assembly is ready to immediately take over the biasing function. The discharge assembly includes a plurality of belt rows extending along a belt length, and a plurality of package spacing ridges including outer engaging edges, with one package spacing ridge of the plurality between each of the plurality of belt rows. The conveyor belt includes a curved configuration such that the conveyor belt engages the forming drum and forms a plurality of relaxed package cavities sized and shaped to receive and retain the separated packages therein immediately after disengagement of the packages from the heated rotary knife assembly. An attenuated pressure (e.g., a pressure less than that applied through direct engagement of a belt without rows) is applied by the outer belt surface spaced from the forming drum and maintains the packages within the package cavities while at the same time substantially preventing the application of elevated forces that would otherwise cause undue pressure on the seams between the cap film and the base film that otherwise cause warping of the edges of the packages.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Packaging System

Figure 1:
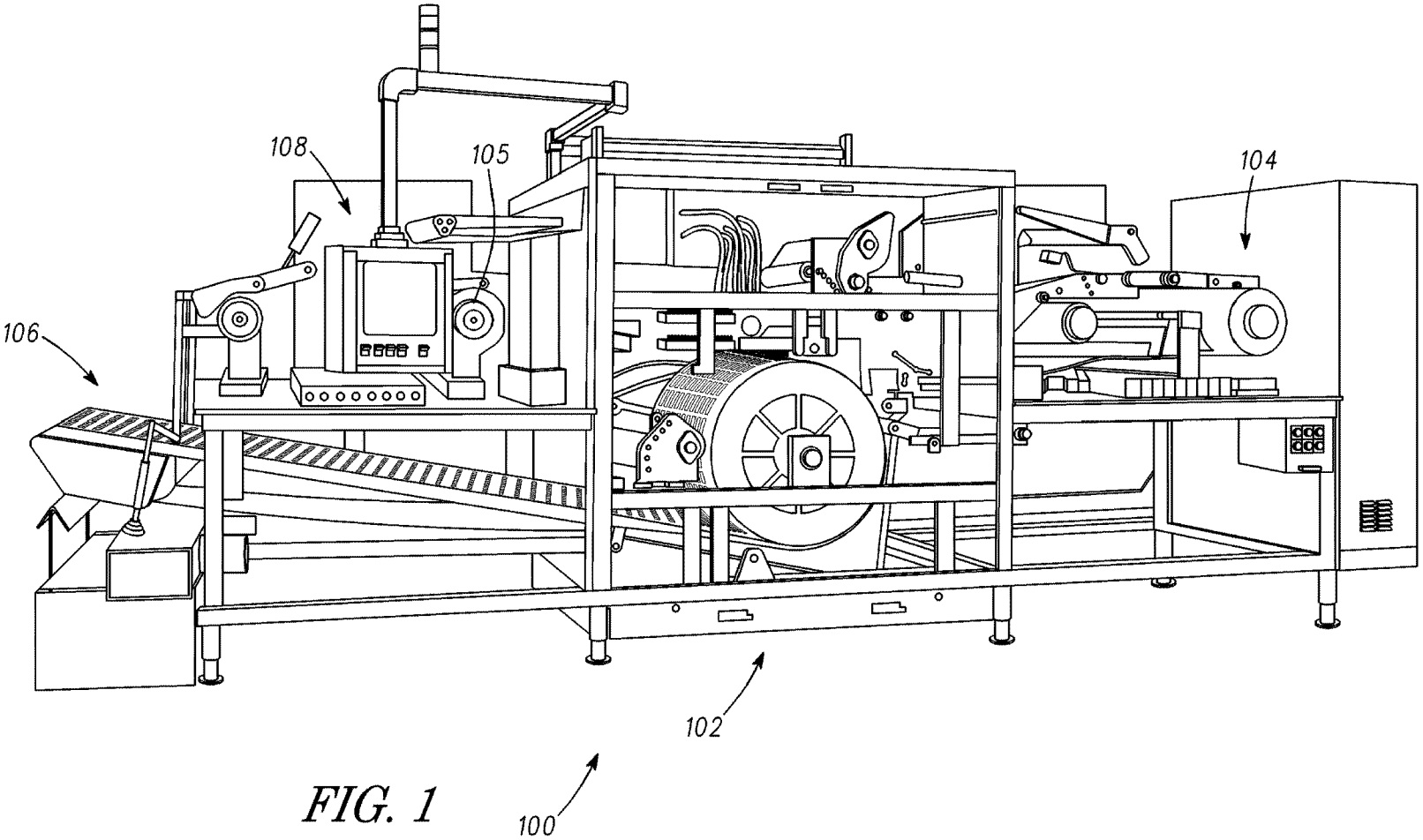
FIG. 1 is an isometric view of one example of a packaging system.

FIG. 1 shows one example of a packaging system 100, for instance, a packaging system configured to form one or more deformable packages containing therein liquids, powders and the like. For instance, the packaging system 100 is configured to form, fill and seal polyvinyl acetate (PVA) films that are in the range of from about 1 millimeter to about 4 millimeters thick. The packaging system 100 fills the packages with, in general, powders and liquids used in laundry, dishwashing, sanitizing and the like. These are single dose packages that are optionally used in home clothes washers, dishwashers or in hospitals to provide cleaning solutions with water and to sanitize surfaces as the water is applied to those surfaces. In one example, the packaging system produces about 400 to 1,500 or more packages per minute.

As further shown in FIG. 1, packaging system 100 includes a filling and sealing assembly 102 positioned toward the center of the packaging system 100. A cap film spool assembly 104 is provided at one end of the packaging system 100 and a base film spool assembly 105 is positioned at the other end of the packaging system 100. As will be described herein, the filming and sealing assembly 102 can cooperate with the cap film spool assembly 104 and the base film spool assembly 105 to form the packages that are discharged at the discharge end 106. As further shown in FIG. 1 an operation console 108 is provided for operation control and monitoring of the package system 100 including the various assemblies and components described herein.

Filling and Sealing Assembly

Figure 2:
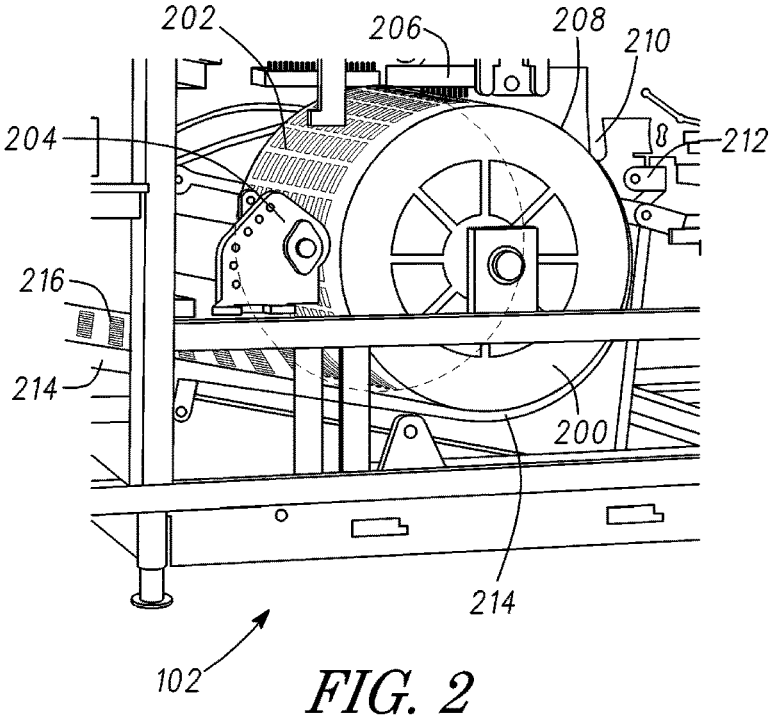
FIG. 2 is a detailed isometric view of one example of a filling and sealing assembly.

FIG. 2 shows a detailed isometric view of the sealing assembly 102. As shown, the assembly 102 includes a forming drum 200 configured to rotate relative to the remainder of the packaging system 100. In one example, the forming drum 200 includes a plurality of package cavities 202 arranged in rows along the forming drum 200 exterior. For instance, as shown in FIG. 2, in one example, the package cavities 202 are arranged in a plurality of rows with approximately 10 to 12 package cavities 202 in each of the rows. The filling and sealing assembly 102 further includes a base film roller 204 configured to apply a film across the package cavities 202. The film is vacuumed into the package cavities 202 to form depressions configured to receive powders, liquids and the like therein.

As further shown in FIG. 2 a package filling assembly 206 arranged near the upper most portion of the forming drum 200. In one example, the package filling assembly 206 includes nozzles, chutes and the like that are sized and shaped to dispense liquids, powders and the like into the package cavities 202 including a base film applied by the base film roller 204 therein. After dispensing of the package contents into the package cavities 202 a cap film administrator 208 applies a cap film over top of the filled package cavities 202 and the base film therein to thereby form completed packages. In one example, one or both of the cap film and the base film are applied to the forming drum 200 at or near their glass transition temperature to ensure a tight seal is formed between the cap film and the base film. For instance, the cap film is applied by the cap film administrator 208 under tension to the forming drum 200 through one or more heated rollers.

In another example, the filling and sealing assembly 102 includes one or more cutting assemblies such as a slitting assembly 210 and a heated rotary knife assembly 212. The slitting assembly 210 is sized and shaped to slit the packages formed along the forming drum 200. For instance, the slitting assembly 210 applies vertical cuts extending along the circumference of the forming drum 200 to cut the plurality of packages formed on the forming drum 200 into elongate strips. The heated rotary knife assembly 212 thereafter applies a heated knife through rotation of a rotating core. The rotating core move in tandem with a linear velocity at the exterior of the heated rotary knife exterior identical or substantially identical to the linear velocity of the forming drum 200 at its interface with the heated rotary knife assembly 212. The heated rotary knife assembly 212 engages with the slit packages to separate each of the slit packages from one another to thereby generate the plurality of packages for eventual delivery to one or more storage devices such as boxes and the like. As further shown in FIG. 2, the filling and sealing assembly 102, in another example, includes a discharge conveyor belt 214 in surface-to-surface engagement with a portion of the forming drum 200 to cradle the packages as they are rolled off of the forming drum 200 and thereafter move the packages 216 along the discharge conveyor belt 214 to the discharge end 106 shown in FIG. 1 for delivery to one or more packaging devices such as crates.

Figure 3:
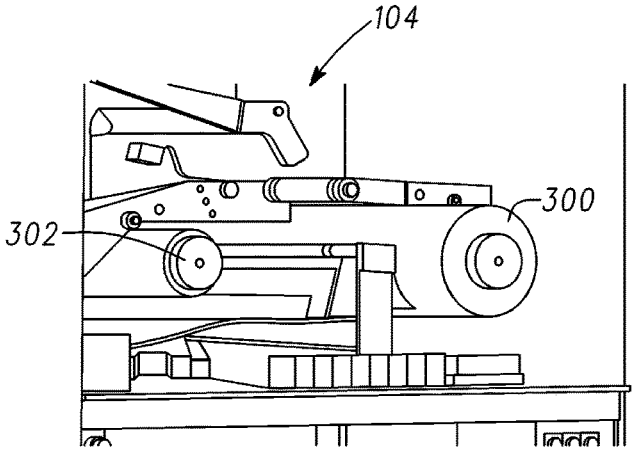
FIG. 3 is a detailed view of one example of film spool assemblies.

FIG. 3 shows one example of a cap film spool assembly 104 as previously shown in FIG. 1. As shown in FIG. 3, the cap film spool assembly 104 includes one or more spools such as a first cap film spool 300 and a second cap film spool 302. The first and second cap film spools either alone or together provide the cap film for application to the forming drum 200, for instance, to form the packages by administration through the cap film administrator 208, as previously described herein.

Heated Rotary Knife Assembly

Figure 4:
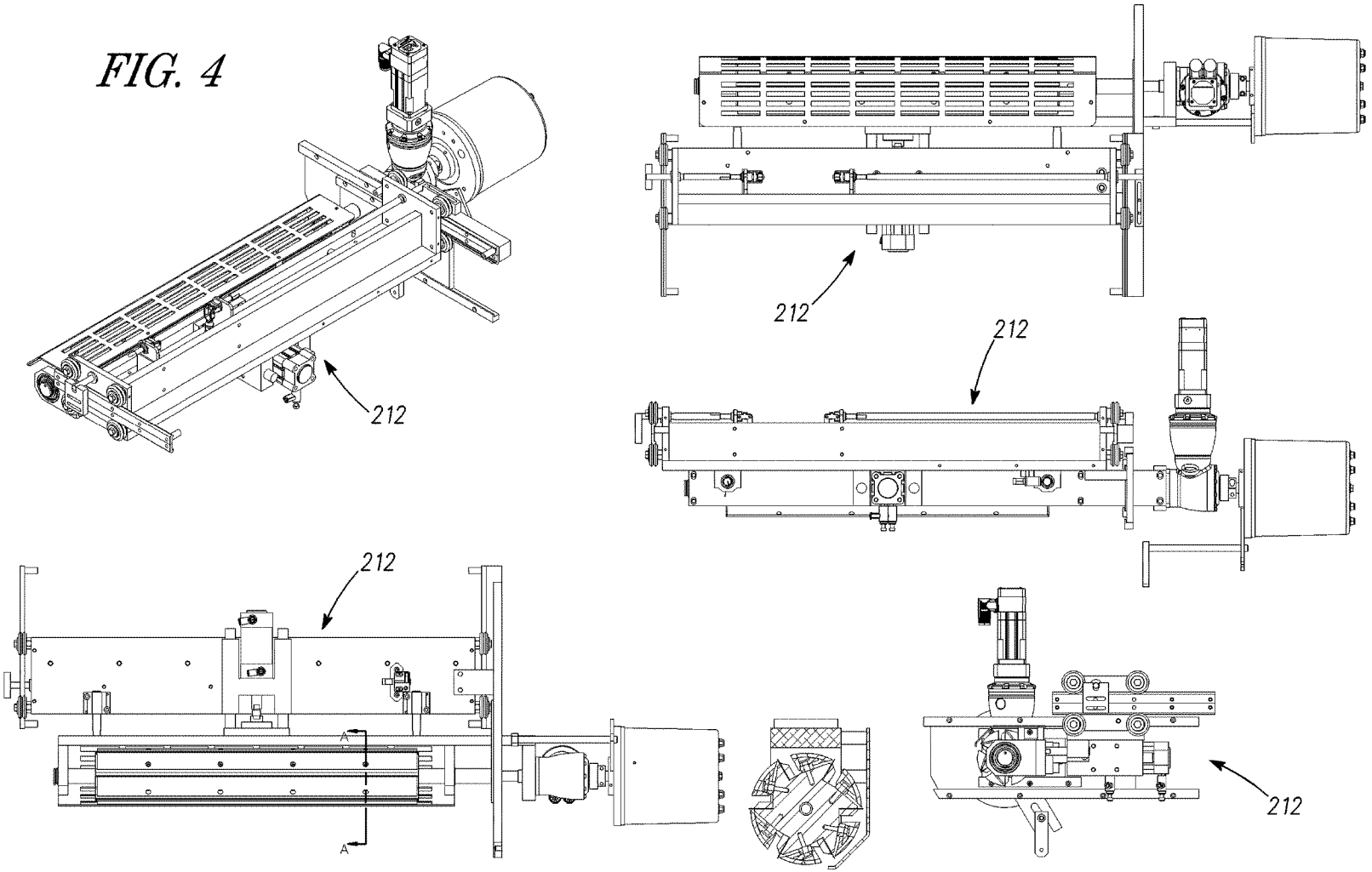
FIG. 4 is a collection of views of a heated rotary knife assembly.

FIG. 4 shows a plurality of views of the heated rotary knife assembly 212 previously shown in FIG. 2 (from top to bottom starting at the left most portion of the figure; perspective, bottom, top, rear, cross-sectional and side views). As will be described herein, the heated rotary knife assembly 212 provides one of the cutting features used to separate the individual packages during the forming process on the forming drum 200 shown in FIG. 2. For instance, the heated rotary knife assembly 212 provides the horizontal cutting to the plurality of packages 216 in the forming drum 200 to separate the strips of packages extending along the circumference in the forming drum 200. As will be further described herein below, the heated rotary knife assembly 212 further provides a support function to the plurality of packages 216 immediately prior to their engagement in surface-to-surface and seated engagement with the discharge conveyor belt 214.

Figure 5A:
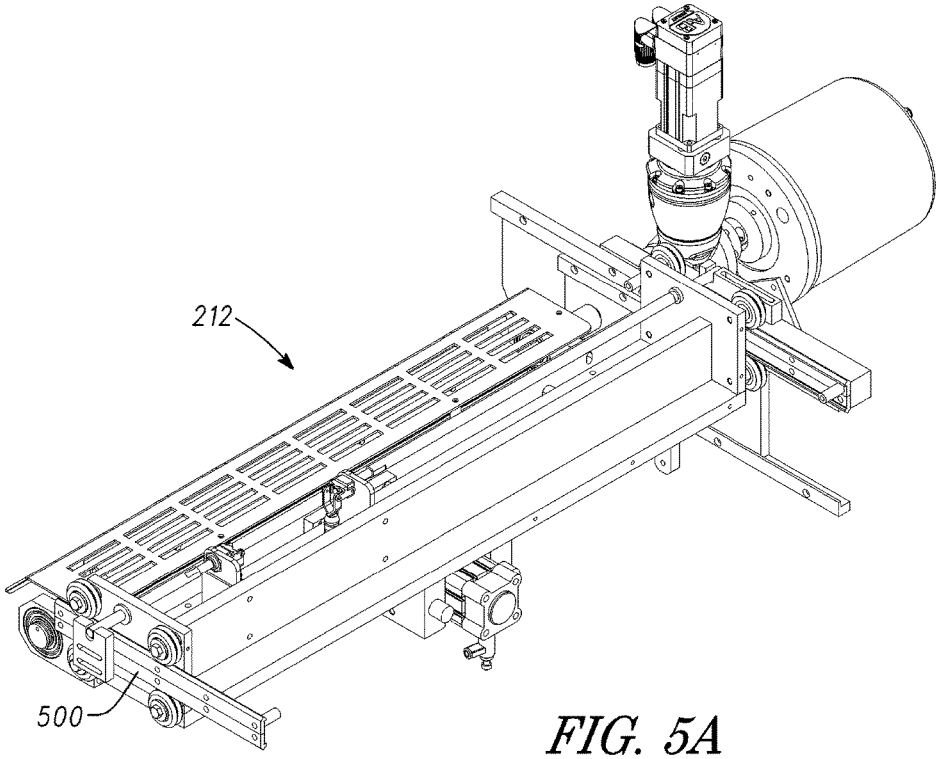
FIG. 5A is an isometric view of the heated rotary knife assembly of FIG. 4.
Figure 5B:
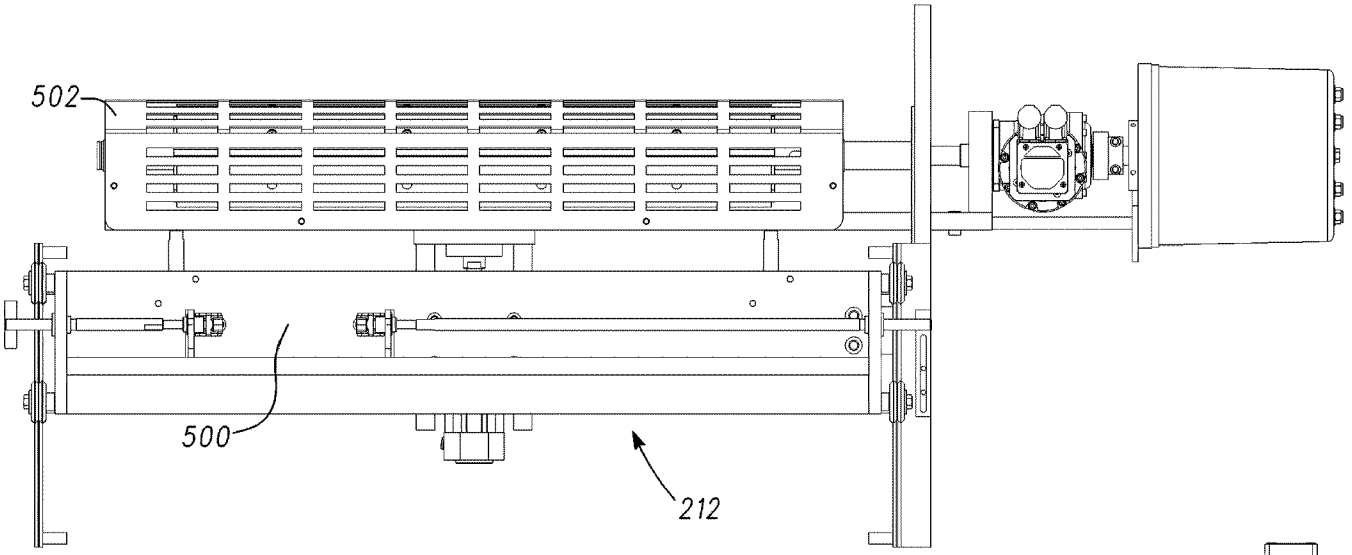
FIG. 5B is a top view of the heated rotary knife assembly of FIG. 4.

Referring first to FIG. 5A, one example of the heated rotary knife assembly 212 is provided including a housing 500 sized and shaped to receive the heated rotary knife therein. As shown, for instance, in FIG. 5B the heated rotary knife assembly 212 further includes a rotary knife screen 502 coupled with the housing 500. The rotary knife screen 502, in one example, is a flange like structure extending over the heated rotary knife.

Figure 5C:
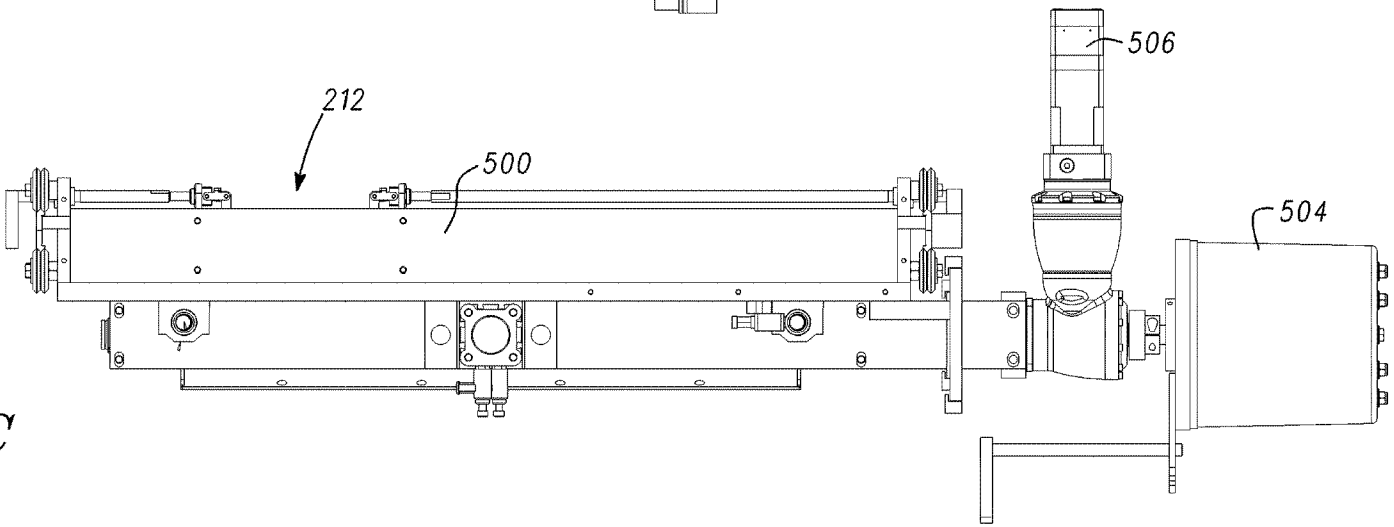
FIG. 5C is a back view of the heated rotary knife assembly of FIG. 4.
Figure 5E:
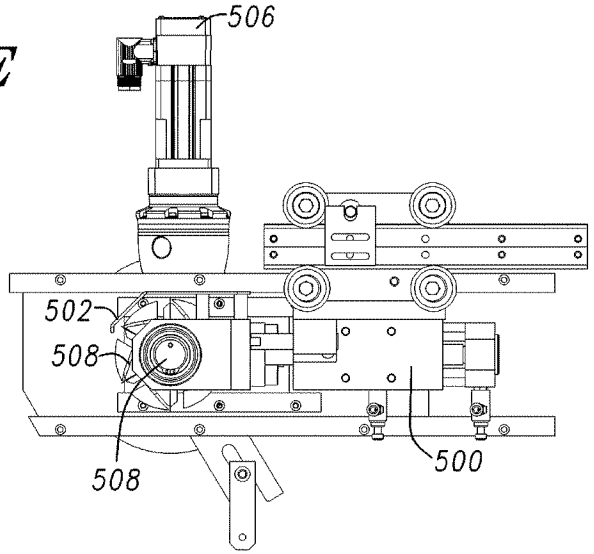
FIG. 5E is a side view of the heated rotary knife assembly of FIG. 4.
Figure 5D:
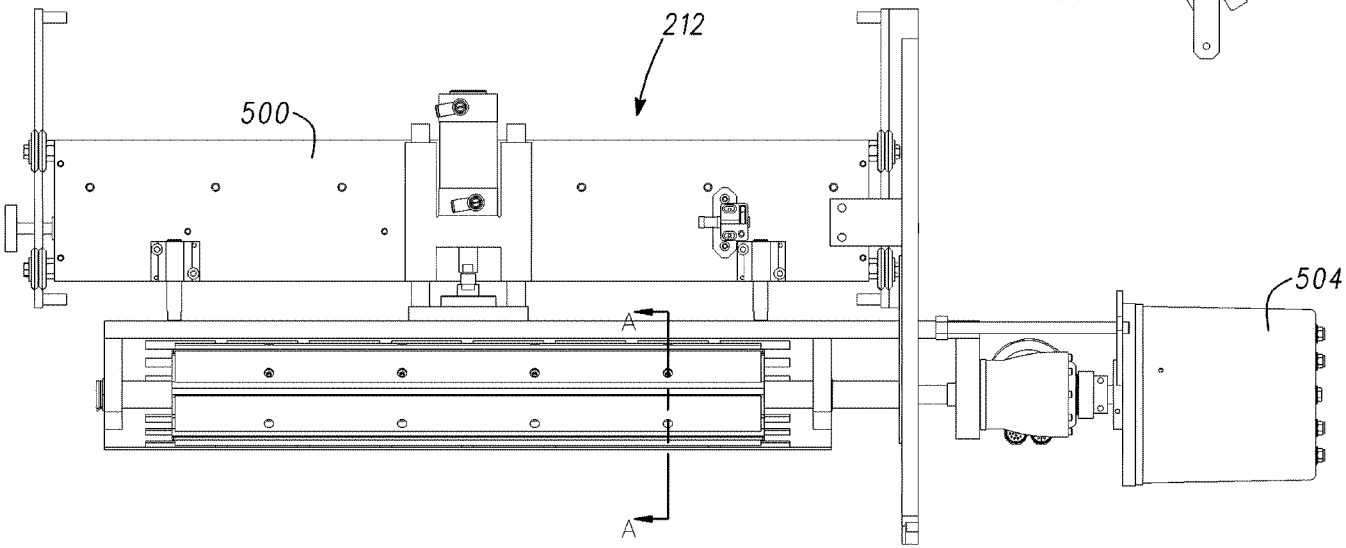
FIG. 5D is a bottom view of the heated rotary knife assembly of FIG. 4.

Referring now to FIG. 5C, the back view of the heated rotary knife assembly 212 shows a motor 506 sized and shaped for rotatable coupling with the rotary knife. In one example, a controller 504 (e.g., an encoder and the like) is coupled with the motor 506 and the rotary knife within the housing 500. In one example, the controller 504 provides one or more of monitoring and control of the motor 506 and monitoring of the rotary knife within the housing 500. Referring to FIG. 5D a drive shaft 508 extends from the motor 506 into engagement with the rotary knife spindle 510 (e.g., the heated rotary knife). As shown in FIG. 5D, the drive shaft 508 is configured to transmit rotational movement from the motor 506 to the rotary knife spindle 510 and thereby ensure the rotary knife spindle 510 is rotated relative to packaging system 100 and rotated in tandem with the forming drum 200 shown in FIG. 2. FIG. 5E shows a side or end view of the heated rotary knife assembly 212 including the drive shaft 508 coupled with the rotary knife spindle 510. As shown the rotary knife spindle 510 is positioned in an offset relation to the housing 500 and the rotary knife screen 502 extending thereabove.

Figure 5F:
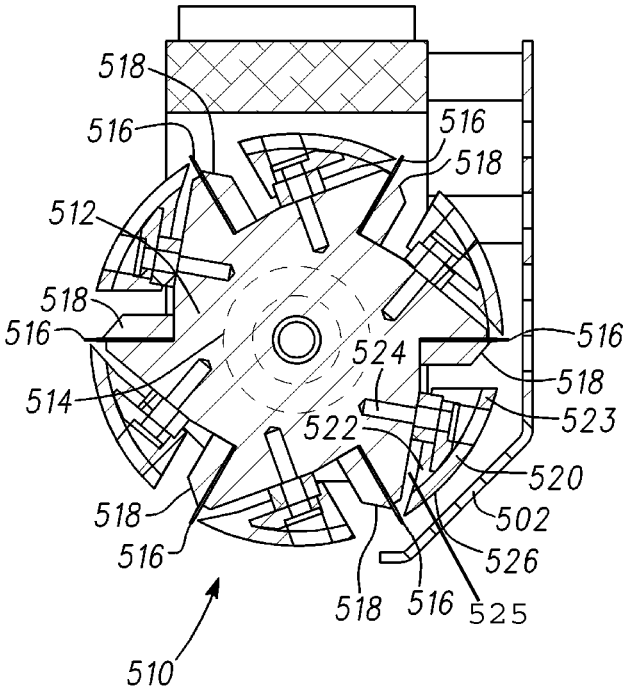
FIG. 5F is cross sectional view of one example of a rotary knife spindle.

Referring now to FIG. 5F, the rotary knife spindle 510 is shown in cross section. In one example, the rotary knife 510 includes a core 512 sized and shaped to be rotatably coupled with drive shaft 508 previously shown herein. Core 512 further includes one or more heating elements 514 extending therein. The heating elements 514 are configured to heat the knife blades 516 extending through the core 512. In other examples, the knife blades 516 are coupled with the core 512, for instance, with clamps 518 positioned around the core 512. In yet another example, the clamps 518 are sized and shaped to serve as heating elements for the knife blade 516. For instance, the clamps 518 include resistive heating elements therein that heat the core 512 including the knife blade 516 adjacent to the clamp 518.

Referring back to FIG. 2, the rotary knife spindle 510 (as shown in FIG. 5D) of the rotary knife assembly 212 is configured (for instance, controlled by the motor 506 as shown in FIG. 5E) to rotate at a linear velocity at its exterior most surface corresponding to a linear velocity of the forming drum 200. Stated another way, the rotary knife spindle 510 (as shown in FIG. 5D) of the rotary knife assembly 212 is configured to rotate at identical speed to the forming drum 200 at the interface between the exterior surfaces of both the rotary knife spindle 510 and the forming drum 200. Rotation of the rotary knife spindle 510 with the forming drum 200 enables the plurality of the knife blades 516 to engage with the films extending across the forming drum 200 and apply a cutting force. For instance, the cutting force is applied in combination with heat to thereby separate each of the packages 216 from one another to form individual packages for delivery to the discharge conveyor belt 214 for eventual delivery to packaging systems such as boxes, bags and the like. In one example, the forming drum 200 includes a plurality of grooves extending along its length, for instance, from one end surface of the drum to an opposed surface of the drum to enable reception of a portion of the knife blade 516 therein. The knife blade 516 is thereby sized and shaped to enter the groove thereby puncturing the film extending across the groove to separate each of the plurality of packages 216 from one another.

Referring again to FIG. 5F, in one example, the rotary knife spindle 510 includes a plurality of package guides 520 interposed between each of the knife blades 516. In one example, each of the package guides 520 includes a guide shoe 522 and a fastener 524 sized and shaped to couple the package guides 520 with the core 512. In one example, the fastener 524 includes but is not limited to screws, rivets, pegs, mechanical interference fittings and the like. In another example, the package guides 520 include guide faces 526 (e.g., silicone guide faces or another heat insulative material) extending along the guide shoes 522 (e.g., the guide faces 526 can extend along a superior surface of the guide shoes 522). The guide faces 526, in one example, have an arcuate configuration that provides a substantially circular shape to the rotary knife spindle 510 when the package guides 520 are viewed in a composite fashion around the rotary knife spindle 510.

Referring again to FIG. 2, as shown and previously described, the forming drum 200 includes a plurality of package cavities 202 formed therein. During the forming process as the heated knife blades 516 engage with the films of the packages 216, the knife blades 516 sever each of the packages 216 from one another. Because the films of the packages 216 are in a heated configuration as the individual packages 216 are severed from their adjacent packages, the films are in a substantially less stretched configuration and the contents and films are biased by the material elasticity toward assuming a more circular or round configuration.

The drawing up of the packages 216 after cutting, in some examples, allows the packages to extend away from the forming drum 200 and undesirably engage the heated knife blade 516. The engagement of one or more of the packages 216 with the heated knife blade allows the heated knife blade to melt and thereby spill the contents of the packages 216 within the packaging system 100. The undesired engagement of the knife blade 516 with the already separated packages 216 and corresponding damage to the packages including spilling of the contents thereby causes downtime and added labor to clean and reset the packaging system 100 to carry on with forming of the packages 216. In the example shown in FIG. 5F, the plurality of package guides 520 provide surfaces sized and shaped to engage with the slitted and cut packages (slit by the slitting assembly 210 and cut by the heated rotary knife assembly 212) to substantially ensure the separated packages 216 do not undesirably engage with the knife blades 516. For instance, the guide faces 526 on the exterior-most surfaces of the package guides 520 engage with the separated packages 216 to substantially maintain the packages 216 within the package cavities 202. Stated another way, the package guides 520 provide an attenuated seating force to the plurality of packages 216 (less than direct engagement of a roller having a diameter nearly corresponding to a radius provided by the blades 516) and substantially maintains the packages within the package cavities 202 even after the slit and cut packages would otherwise naturally deform or attempt to assume a more round shape.

The package guides 520 allow the packages 216 to extend from the package cavities 212 and otherwise engage with the heated knife blades 516 for cutting while at the same time preventing undesirable non-cutting engagement with the blades 516. In one example, because the package guides 520 include guide faces 526, the guide faces 526 are at a substantially decreased temperature relative to the knife blades 516 and thereby ensure that the rotary knife spindle 510 does not undesirably apply heat to surfaces of the separated packages 216 that would otherwise cause damage to the package 216, and in some circumstances, possibly spill the contents of the package 216 within the packaging system 100. For example, a temperature of the guide faces 526 can be maintained a temperature that is below a breakdown temperature of a material that forms the plurality of packages. In an example, the breakdown temperature includes, but not limited to, the glass transition temperature, melting temperature, decomposition temperature or the like of the material used in the package films (e.g., a temperature that would cause damage to a package when an instrument heated to that degree was engaged with the package). For instance, with a package formed with polyvinyl alcohol the guide face is maintained at temperature less than the glass transition temperature (around 85 degrees Celsius).

In one example, the package guides 520 include insulation elements 523. The insulation elements 523 are interposed between the heating element 514 and the guide face 526. The insulation elements 523 help reduce heat transfer from the heating element 514 to the guide faces 526 to ensure that the rotary knife spindle 510 does not undesirable apply heat to surfaces of the separated packages 216. In one example, the guide face 526 of the one or more package guides 520 can be formed with the thermally resistant material (e.g., silicone) such that an exterior surface of the guide face 526 that engages the separated packages 216. In one example, the insulation element 523 can be positioned, for example, between the guide shoe 522 and the guide face 526.

In an example, package guides 520 are isolated from an exterior surface of the core 512. For example, the fastener 524 coupling the package guides 520 to the core 512 couples the package guides 520 such that a space 525 is formed between a surface of the package guides 520 that opposes the exterior surface of the core 512. Forming the space 525 can further reduce heat transfer from the heating element 514 to the guide faces 526 by spacing the guide faces 526 a distance from the core 512. In another example, package guides 520 engage with the packages 216 while the packages are within the package cavities 202. The package guides 520 gently seat the packages 216 (with attenuated force less than that of a roller having a diameter more closely matching the radius of the blades 516 within the package cavities 212 until the discharge conveyor belt 214 is ready to immediately take over the biasing function of biasing the packages 216 along the forming drum 200 until the packages 216 are delivered fully to the discharge conveyor belt 214, as shown in FIG. 2. Once the packages 216 are delivered to the discharge conveyor belt 213, the packages 216 are then delivered to the discharge end 106 of the packaging system 100, as shown in FIG. 1. That is to say the package guides 520 provide their support function and thereby maintain the packages 216 away from the heated knife blades 516 during rotation of the forming drum 200 until the moment the discharge conveyor belt 214 engages with the forming drum 200 adjacent to and immediately below the heated rotary knife assembly 212, as shown in FIG. 2 (e.g., at an interface between the heated rotary knife assembly 212 and the discharge conveyor belt 214).

Discharge Assembly

Figure 6:
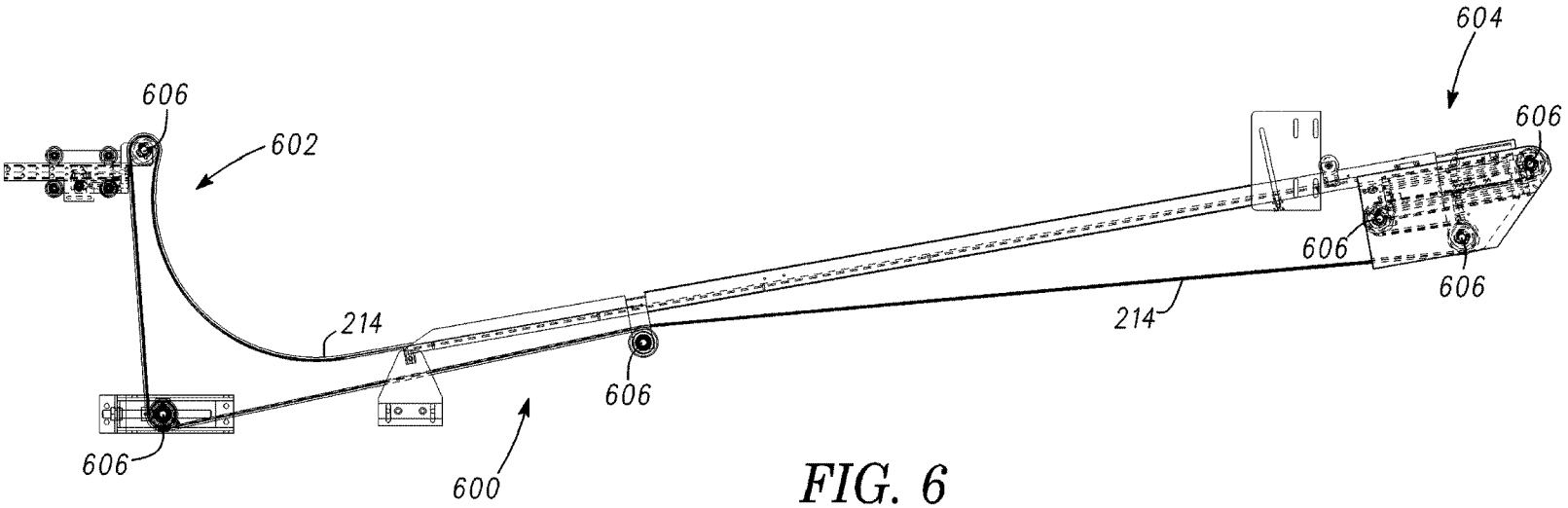
FIG. 6 is a side view of a discharge conveyor assembly.

FIG. 6 shows one example of a discharge assembly 600 including the discharge conveyer belt 214 previously shown in FIG. 2. As shown, the discharge assembly 600 includes a discharge belt exit 604 and a discharge belt entrance 602. In one example, the discharge belt entrance 602 is sized and shaped to engage in surface-to-surface contact with the forming drum 200, as previously described herein. As further shown in FIG. 6, the discharge conveyer belt 214 includes a plurality of rollers 606 sized and shaped to provide one or more of tensioning or driving to the discharge conveyer belt 214 to ensure the discharge conveyer belt 214 moves at an appropriate speed, for instance, a corresponding linear velocity relative to the outside linear velocity of the forming drum 200. As previously described herein, the discharge conveyer belt 214 shown in FIG. 6 are sized and shaped to take the separated packages 216 from the forming drum 200 and supply them to the discharge end 106 shown in FIG. 1 for delivery to one or more end packages, such as bags, boxes and the like.

Figure 7A:
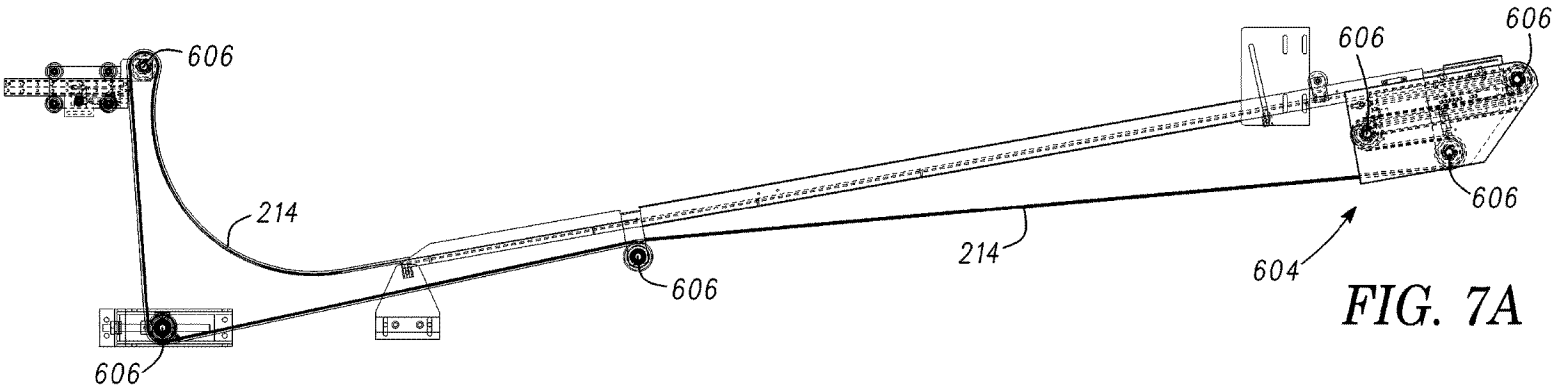
FIG. 7A is a side view of the discharge conveyor assembly of FIG. 6.

Referring now to FIG. 7A, the discharge conveyer belt 214 extends in a circular path around a plurality of rollers 606. In an example, one or more of the rollers 606 is sized and shaped to provide tension to the discharge conveyer belt 214 and thereby ensure the driving rollers 606 are able to engage in frictional non-slipping contact with discharge conveyer belt. In another example, the rollers 606 are arranged as shown in FIG. 7A to provide a curve or catenary type configuration as shown at the discharge belt entrance 602. The curved configuration of the discharge conveyer belt 214 is sized and shaped to engage in surface-to-surface or near surface-to-surface contact with the forming drum 200. In an example, the engagement enables the forming drum 200 to drive the rotation of the discharge conveyer belt 214. For instance, the forming drum 200 is configured to transmit rotational movement to the discharge conveyor belt 214 and thereby ensure that the discharge conveyor belt 200 is rotated in tandem with the forming drum 200.

In an example, the engagement of the discharge conveyer belt 214 along at least an arcuate portion of the forming drum 200 ensures the plurality of separated packages 216 are retained in the package cavities 202, for instance, by engagement of the previously described package guides 520 of the rotary knife assembly and are further retained within the package cavities 202 as the packages 216 are translated around and under the forming drum 200 until the discharge conveyer belt 214 fully supports the packages 216 and is able to deliver the packages to the discharge belt exit 604 as shown in FIG. 7A (and also shown in FIG. 1 at the discharge end 106). Stated another way, the rotary knife assembly and the discharge conveyor belt are positioned adjacent to one another (e.g., at an interface between each) and as the bias provided by the package guides 520 comes to an end the discharge conveyor belt immediately assumes biasing of the packages in the package cavities 202. That is to say, the rotary knife assembly and the discharge conveyor belt 214 provide one or more of continuous engagement or bias to the packages 216.

Figure 7C:
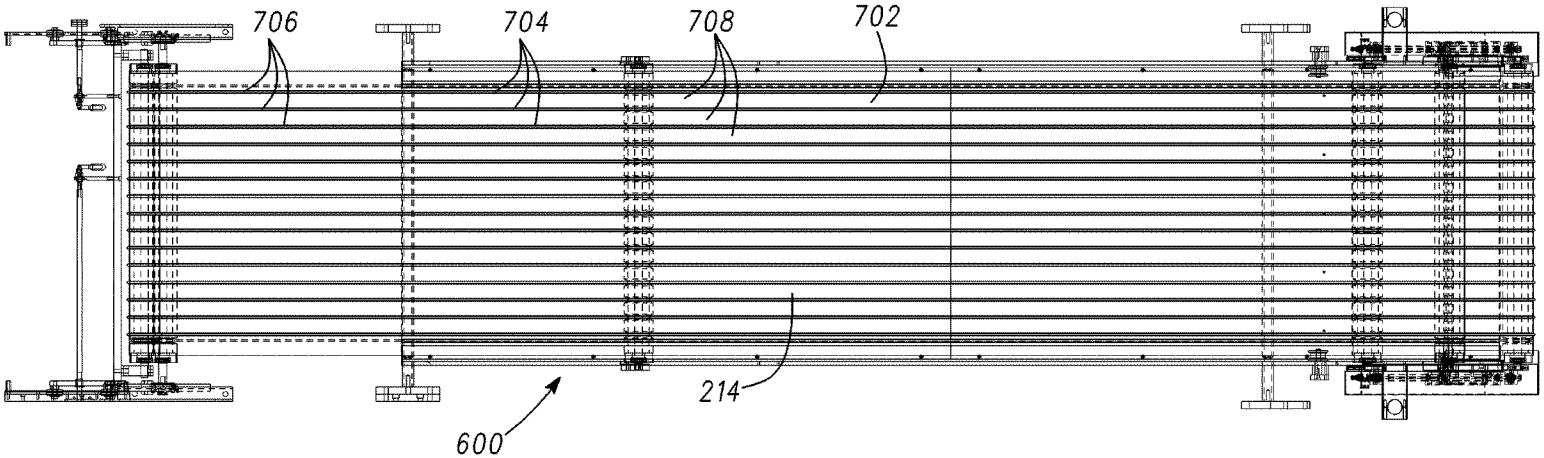
FIG. 7C is a top view of the discharge conveyor assembly of FIG. 6.
Figure 7B:
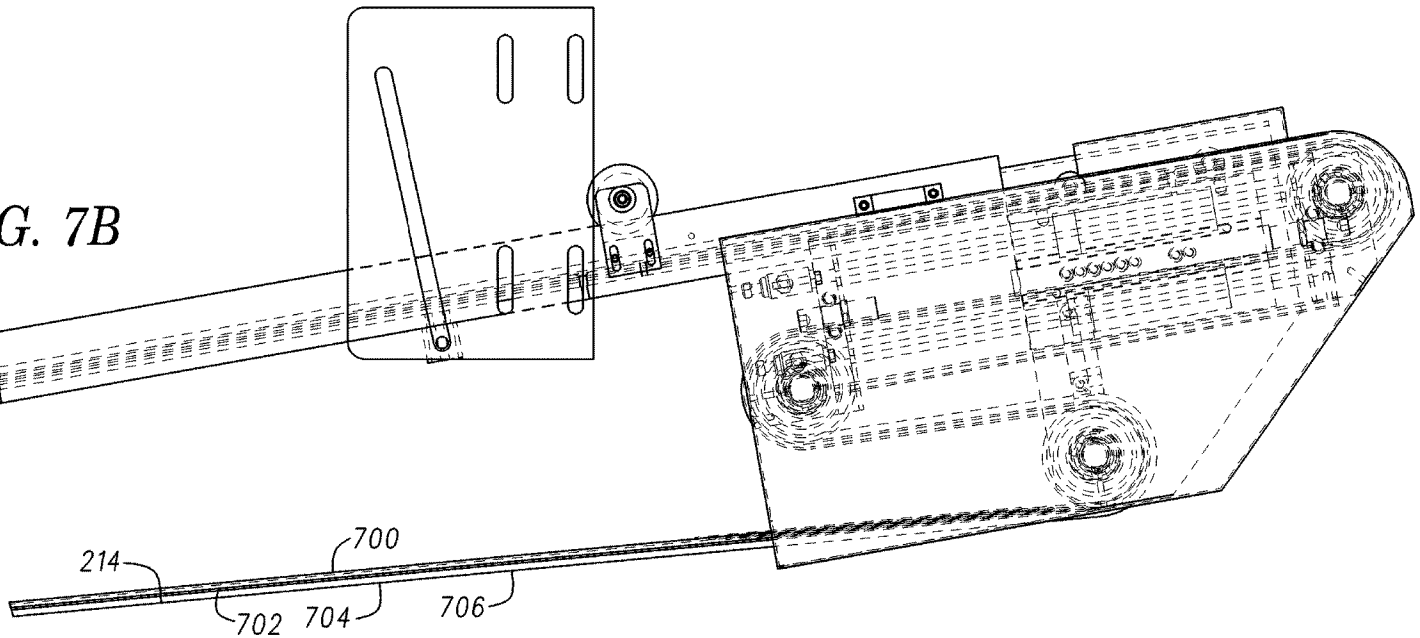
FIG. 7B is a detailed side view of a discharge end of the discharge conveyor assembly of FIG. 6.

Referring now to FIG. 7B, a detailed view of the discharge conveyer belt 214 is provided, for instance, at the discharge belt exit 604. As shown, the discharge conveyer belt 214 includes an inner belt surface 700 and an outer belt surface 702. As shown in FIG. 7B, a plurality of package spacing ridges 704 are arranged on the outer belt surface 702. As will be described herein the plurality of package spacing ridges 704 offset or space the outer belt surface 702 from the forming drum 200. As shown, for instance in FIG. 7B, the plurality of package spacing ridges 704, in one example, includes corresponding outer engaging edges 706 along the uppermost surfaces of the package spacing ridges 704 (downward most surfaces in the view shown in FIG. 7B). The outer engaging edges 706 are sized and shaped to engage with corresponding surfaces of the forming drum 200 to thereby space the outer belt surface 702 from the forming drum 200.

As will be described herein, the combination of the forming drum 200, for instance, the package cavities 202, the outer belt surface 702 and the boundaries provided by the package spacing ridges 704 form a plurality of relaxed package cavities 800 (shown in FIG. 8) sized and shaped to receive and retain the separated packages 216 therein immediately after disengagement of the packages 216 from the heated rotary knife assembly 212. For instance, the rotary knife spindle 510 previously described here.

Referring now to FIG. 7C, a top view of the discharge conveyer belt 214 is shown. As shown, the plurality of package spacing ridges 704 separate a corresponding plurality of belt rows 708 therebetween. For instance, the plurality of belt rows 708 are bounded by the package spacing ridges 704 extending from the outer belt surface 702. As further shown in FIG. 7C, the outer engaging edges 706 are the upper surfaces of the package spacing ridges 704 and are sized and shaped to engage with the forming drum 200 to form the relaxed package cavities 800 (see FIG. 8) as described previously.

In one example, the discharge conveyer belt material includes, but is not limited to, a plastic coated belt, for instance, a neoprene belt. Optionally, the discharge conveyer belt 214 includes, but is not limited to, composite materials such as a flexible polymer including a reinforcing belt therein. In another example, the plurality of package spacing ridges 704 are similarly formed of a flexible polymer, for instance, the same polymer used in the construction of the discharge conveyer belt 214. The plurality of package spacing ridges 704, in one example, are formed, for instance, through molding, bonding and the like of the package spacing ridges 704 to the discharge conveyer belt 214. In another example, the package spacing ridges 704 are co-formed, for instance, through molding of the package spacing ridges with the construction of the discharge conveyer belt 214. In yet another example, the package spacing ridges 704 are coupled with the discharge conveyer belt 214, for instance, by one or more of welds, adhesives, and the like. In still another example, the package spacing ridges 704 are constructed with a plurality of separate but sequential ridges arranged in a linear fashion along the discharge conveyer belt to allow for bending and flexing of the discharge conveyer belt 214, for instance, as it wraps around the forming drum 200 and translates around the plurality of rollers 606.

In operation, the discharge conveyer belt 214 rotates around the plurality of rollers 606, for instance, at a speed substantially similar to the linear velocity of the circumference of the forming drum 200. As previously described, the discharge conveyer belt 214 is sized and shaped to extend along at least a portion of the forming drum 200, for instance, from a point immediately adjacent to the heated rotary knife assembly 212 (e.g., an interface between the assembly 212 and the discharge conveyor belt 214) to a position substantially near the bottom of the forming drum 200. The discharge conveyer belt 214 engages along the forming drum 200 to ensure the separated packages 216 are substantially retained within their package cavities 202 after slitting and cutting by the slitting assembly 210 and the heated rotary knife assembly 212. For instance, the discharge conveyer belt 214 provides an engaging surface along the forming drum 200 to maintain the heated packages 216 including the heated films thereon at least partially within the respective package cavities 202 until the packages 216 are at a position, for instance, at the bottom of the forming drum 200 to be easily lifted away from the forming drum 200 and thereafter delivered to the discharge end 106 shown in FIG. 1.

In one example, the discharge conveyer belt 214 applies a pressure along the forming drum 200 including a pressure applied to the packages 216. In some examples, without the package spacing ridges 704 the outer belt surface 702 provides an elevated force or pressure to the packages 216 greater than that applied with a recessed engagement facilitated by the engagement of package spacing ridges 704 with the forming drum 200. Because the films of the packages 216 are in a heated configuration after bonding of the cap film with the base films and cutting with the heated rotary knife assembly 212 the application of elevated force or pressure to the packages 216 causes the edges of the packages to fray or warp (thereby affecting the aesthetic appearance of the packages 216 and in extreme cases causing splitting of the packages along their seams between the cap and base films).

In the example with the package spacing ridges 704, the outer belt surface 702 is offset from the packages 216 within the forming drum 200. Stated another way, the outer belt surface 702 is spaced from the outer perimeter of the forming drum 200 according to the depth of the package spacing ridges 704, for instance, the depth from the outer engaging edges 706 to the outer belt surface 702. While the discharge conveyer belt 214 is engaged along the forming drum 200, for instance, from the arcuate position immediately adjacent to the heated rotary knife assembly 212 (e.g., an interface) to a position near the bottom of the forming drum 200, the package spacing ridges 704, the outer belt surface 702, and the forming drum 200 cooperate to form the relaxed package cavities 800 previously described herein.

Figure 8:
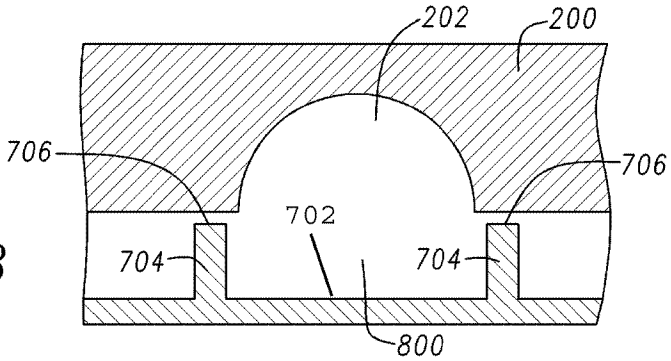
FIG. 8 is a schematic view of one example of a relaxed package cavity.

As shown in FIG. 8, the outer belt surface 702 in this configuration is spaced from the forming drum 200 but at the same time is able to apply an attenuated pressure (less than with close proximate engagement without the ridges) to the packages 216 within their package cavities 202. The spacing of the outer surface belt 702 from the forming drum 200 in FIG. 8 is enhanced for ease of viewing. The configuration of the package shown in FIG. 8 is exaggerated to show the engagement between the package spacing ridges 704 and the forming drum 200 and accordingly the relaxed package cavity 202 formed therebetween.

The attenuated pressure applied by the spaced outer belt surface 702 maintains the packages 216 within the package cavities 202 while at the same time substantially preventing the application of elevated forces that would otherwise cause undue pressure on the seams between the cap film and the base film thereby causing warping of the edges of the packages 216. That is to say, the outer belt surface 702, when spaced away from the forming drum 200 by the package spacing ridges 704, is able to retain the packages 216 in a substantially seated orientation along the forming drum 200. The outer belt surface 702 is able to retain the packages in the substantially seated orientation without allowing a collision of the packages 216 against each other, for instance, by sliding along the forming drum 200 or the discharge conveyer belt 214. The outer belt surface 702 can prevent the collision of packages 216 and retain the packages 216 adjacent to the forming drum 200 (e.g., at least partially within the package cavities 202) without applying an elevated pressure that would otherwise cause damage or warping to the packages, for instance, along the seam between the cap and base film.

Various Notes & Examples

Each of these non-limiting examples can stand on its own, or can be combined in any permutation or combination with any one or more of the other examples.

Example 1 can include subject matter such as a rotary knife assembly. The rotary knife assembly includes a rotatable core, a plurality of knife blades extending from the rotatable core, a heating element coupled with the plurality of knife blades, the heating element is configured to heat the plurality of knife blades for cutting of one or more deformable packages, and one or more package guides interposed between each of the plurality of knife blades. The one or more package guides includes a guide face configured to couple along the one or more deformable packages as the rotatable core is rotated, the guide face biases the one or more deformable packages away from the plurality of heated knife blades, and an insulation element interposed between the heating element and the guide face, the insulation element reduces heat transfer to the guide face.

Example 2 can include, or can optionally be combined with the subject matter of Example 1, to optionally include where the one or more package guides includes a guide shoe having a superior surface, and a fastener, wherein the guide face extends along the superior surface and the fastener couples the one or more package guides to the rotatable core.

Example 3 can include, or can optionally be combined with the subject matter of one or any combination of Examples 1 or 2 to optionally include where the fastener isolates the one or more package guides from the rotatable core by a distance, the distance reduces heat transfer to the guide face from the rotatable core.

Example 4 can include, or can optionally be combined with the subject matter of one or any combination of Examples 1 through 3 to optionally include where the guide face has an arcuate configuration.

Example 5 can include, or can optionally be combined with the subject matter of one or any combination of Examples 1 through 4 to include where the heating element extends within the rotatable core.

Example 6 can include, or can optionally be combined with the subject matter of Examples 1 through 5 to optionally include a plurality of clamps positioned around the rotatable core, the plurality of clamps configured to couple the plurality of knife blades to the rotatable core.

Example 7 can include, or can optionally be combined with the subject matter of Examples 1 through 6 to optionally include where the heating element includes a plurality of clamps each including a resistive heating element, the resistive heating element configured to heat one or more of the knife blades.

Example 8 can include, or can optionally be combined with the subject matter of Examples 1 through 7 to optionally include a motor rotatably coupled with the rotatable core, a drive shaft extending from the motor into engagement with the rotatable core, the drive shaft configured to transmit rotation movement from the motor to the rotatable core, and a controller coupled with the motor, the controller configured to control the motor to rotate the rotatable core such that a linear velocity at its exterior most surface corresponds to a linear velocity of a forming drum that is carrying the one or more deformable packages.

Example 9 can include, or can optionally be combined with the subject matter of Examples 1 through 8 to optionally include where the plurality of knife blades are configured to enter a groove of the forming drum positioned between adjacent deformable packages to engage with a material extending across the forming drum and separate the adjacent deformable packages.

Example 10 can include, or can optionally be combined with the subject matter of Examples 1 through 9 to optionally include where the plurality of knife blades have a temperature that is greater than a melting point temperature of a material the knife is configured to cut.

Example 11 can include, or can optionally be combined with the subject matter of Examples 1 through 10 to optionally include where the guide face is configured to couple along the one or more deformable packages and biases the one or more deformable packages away from the plurality of heated knife blades after cutting of the one or more deformable packages with the heated knife blades.

Example 12 can include, or can optionally be combined with the subject matter of Examples 1 through 11 to optionally include where the guide face is configured to couple along the one or more deformable packages and biases the one or more deformable packages toward one or more package cavities of a forming drum.

Example 13 can include, or can optionally be combined with the subject matter of Examples 1 through 12 to optionally include a forming drum including a plurality of package cavities, a base film spool assembly configured to apply a base film across the plurality of package cavities, a filling assembly configured to apply a material to the plurality of package cavities, and a cap film spool assembly configured to apply a cap film over the plurality of package cavities forming the one or more deformable packages.

Example 14 can include subject matter such as a method. The method can include rotating a rotatable core in correspondence with a forming drum, the forming drum having a plurality of packages extending along the circumference of the forming drum, heating a plurality of knife blades with a heating element, the knife blades extending from the rotatable core, insulating a guide face of one or more package guides from the heating element to reduce heat transfer from the heating element to the guide face, the package guides interposed between each of the plurality of knife blades, separating each of the plurality of packages from one another to form individual packages, and biasing the one or more individual packages away from the plurality of knife blades with the guide face coupled along the one or more individual packages.

Example 15 can include, or can optionally be combined with the subject matter of Example 14 to optionally include where separating each of the plurality of packages from one another includes applying a cutting force from the plurality of knife blades to a film connecting the deformable packages.

Example 16 can include, or can optionally be combined with the subject matter of Examples 14 or 15 to optionally include where separating each of the plurality of packages from one another includes applying heat from the plurality of knife blades to the film connecting the deformable packages.

Example 17 can include, or can optionally be combined with the subject matter of Examples 14 through 16 to optionally include where biasing the one or more individual packages away from the plurality of knife blades includes coupling the guide face of the one or more package guides along the one or more deformable packages to maintain the one or more individual packages within one or more package cavities of the forming drum.

Example 18 can include, or can optionally be combined with the subject matter of Examples 14 through 17 to optionally include contacting the guide face of the one or more package guides after separating each of the plurality of packages from one another.

Example 19 can include, or can optionally be combined with the subject matter of Examples 14 through 18 to optionally include maintaining a temperature of the guide face below a breakdown temperature of a material that forms the plurality of packages.

Example 20 can include, or can optionally be combined with the subject matter of Examples 14 through 19 to optionally include where insulating the guide face of the one or more package guides from the heating element includes isolating the one or more package guides from an opposing surface of the rotatable core.

Example 21 can include, or can optionally be combined with the subject matter of Examples 14 through 20 to optionally include where insulating the guide face of the one or more package guides from the heating element includes forming the guide face of the one or more package guides with a thermally resistant material.

Example 22 can include subject matter such as a discharge assemble. The discharge assembly includes a rotatable core a conveyor belt including inner and outer belt surfaces, a plurality of belt rows extending along a belt length, and a plurality of package spacing ridges including outer engaging edges, with one package spacing ridge of the plurality of package spacing ridges between each of the plurality of belt rows, and the outer belt surface is recessed from the outer engaging edges.

Example 23 can include, or can optionally be combined with the subject matter of Example 22 to optionally include a forming drum configured to roll in engagement with the conveyor belt along the plurality of package spacing ridges.

Example 24 can include, or can optionally be combined with the subject matter of Examples 22 or 23 to optionally include where the forming drum includes a plurality of package cavities coincident with the plurality of belt rows.

Example 25 can include, or can optionally be combined with the subject matter of Examples 22 through 24 to optionally include where a relaxed package cavity is formed by the outer belt surface, the plurality of package spacing ridges, and a portion of the forming drum including one of the plurality of package cavities.

Example 26 can include, or can optionally be combined with the subject matter of Examples 22 through 25 to optionally include where the package spacing ridges offset the outer belt surface from the forming drum.

Example 27 can include, or can optionally be combined with the subject matter of Examples 22 through 26 to optionally include where the plurality of package spacing ridges are constructed with a plurality of separated sequential ridges linearly arranged along the outer belt surface.

Example 28 can include, or can optionally be combined with the subject matter of Examples 22 through 27 to optionally include where the conveyor belt includes an arcuate portion at a conveyor belt entrance.

Example 29 can include, or can optionally be combined with the subject matter of Examples 22 through 28 to optionally include where the arcuate portion of the conveyor belt configured to engage a surface of a forming drum in surface to surface contact along a length of the arcuate portion.

Example 30 can include, or can optionally be combined with the subject matter of Examples 22 through 29 to optionally include where the conveyor belt seats a plurality of packages within respective package cavities of the plurality of package cavities along the arcuate portion.

Example 31 can include, or can optionally be combined with the subject matter of Examples 22 through 30 to optionally include where the arcuate portion is engaged along an underside portion of the forming drum.

Example 32 can include, or can optionally be combined with the subject matter of Examples 22 through 31 to optionally include a forming drum including a plurality of package cavities, a base film spool assembly configured to apply a base film across the plurality of package cavities, a filling assembly configured to apply a material to the plurality of package cavities, and a cap film spool assembly configured to apply a cap film over the plurality of package cavities forming a plurality of packages.

Example 33 can include subject matter such as a method. The method includes rotating a conveyor belt, the conveyor belt including a plurality of belt rows extending along a belt length and a plurality of package spacing ridges extending from the outer belt surface between each of the plurality of belt rows, forming a plurality of relaxed package cavities between the conveyor belt and a forming drum, the forming drum including a plurality of package cavities coincident with the plurality of belt rows, receiving an individual deformable package within each relaxed package cavity of the plurality of relaxed package cavities, and separating the individual deformable package from the package cavity of the forming drum with the rotating conveyor belt.

Example 34 can include, or can optionally be combined with the subject matter of Example 33 to optionally include where forming the plurality of relaxed package cavities between the conveyor belt and the forming drum includes contacting an outer engaging edge of the plurality spacing ridges with the forming drum.

Example 35 can include, or can optionally be combined with the subject matter of Examples 33 or 34 to optionally include where the plurality of relaxed package cavities are bounded by the outer belt surface, the plurality of package spacing ridges, and a portion of the forming drum including the package cavities.

Example 36 can include, or can optionally be combined with the subject matter of Examples 33 through 35 to optionally include where contacting includes rolling the forming drum in engagement with the conveyor belt along the plurality of package spacing ridges.

Example 37 can include, or can optionally be combined with the subject matter of Examples 33 through 36 to optionally include maintaining the engagement between the forming drum and the conveyor belt from a first position adjacent to a cutting station until a second position at an underside of the forming drum.

Example 38 can include, or can optionally be combined with the subject matter of Examples 33 through 37 to optionally include where at the first position, the conveyer belt and the plurality of package cavities support the individual deformable packages.

Example 39 can include, or can optionally be combined with the subject matter of Examples 33 through 38 to optionally include where at the second position, the conveyer belt fully supports the packages.

Example 40 can include, or can optionally be combined with the subject matter of Examples 33 through 39 to optionally include where forming the plurality of relaxed package cavities includes spacing the outer belt surface from the forming drum.

Example 41 can include, or can optionally be combined with the subject matter of Examples 33 through 40 to optionally include delivering the individual deformable packages to a discharge end of the conveyer belt.

Example 42 can include, or can optionally be combined with the subject matter of Examples 33 through 41 to optionally include maintaining the individual deformable packages within respective package cavities of the plurality of package cavities with an arcuate portion of the conveyor belt, the arcuate portion of the conveyor belt engaging a surface of the forming drum in surface to surface contact along a length of the arcuate portion.

Example 43 can include, or can optionally be combined with the subject matter of Examples 33 through 42 to optionally include where rotating the conveyor belt includes engaging a portion of the conveyor belt with a surface of the forming drum such that rotation of the forming drum rotates the conveyor belt.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A discharge assembly comprising:

a conveyor belt including inner and outer belt surfaces, the conveyor belt including:

a plurality of continuous package spacing ridges protruding from the outer belt surface and extending along the entire belt length, a plurality of belt rows between adjacent package spacing ridges, wherein each of the package spacing ridges includes a continuous outer engaging edge, and wherein the outer belt surface is recessed from the continuous outer engaging edges of said package spacing ridges; and a rotatable forming drum having an exterior surface with an outer perimeter and including a plurality of package cavities in the exterior surface, said continuous outer engaging edges of said continuous package spacing ridges of said conveyor belt are disposed in rolling operative facing relation with the exterior surface of the forming drum, said plurality of continuous package spacing ridges spacing the outer belt surface from that portion of the exterior surface of the forming drum during said rolling operative facing relation, and wherein a relaxed package receiving cavity is formed between the conveyor belt outer belt surface and the exterior surface of the forming drum by the portion of the outer belt surface facing the forming drum during the rolling operative facing relation, with boundaries provided by adjacent package spacing ridges of the plurality of continuous package spacing ridges, and the package cavities of the plurality of package cavities in the forming drum in the portion of said exterior surface in rolling operative facing relation with said continuous engaging edges.

2. The discharge assembly of claim 1, wherein a spacing distance between adjacent continuous package spacing ridges of the plurality of continuous package spacing ridges exceeds the width of the package cavities in the exterior surface of the forming drum, and the plurality of package cavities are in rows coincident with the plurality of belt rows between adjacent continuous package spacing ridges.

3. The discharge assembly of claim 1, wherein the plurality of continuous package spacing ridges offset the outer belt surface from the outer perimeter of the forming drum.

4. The discharge assembly of claim 3, wherein the plurality of continuous package spacing ridges comprise a plurality of separated sequential ridges extending linearly along the outer belt surface.

5. The discharge assembly of claim 3, wherein the conveyor belt has an arcuate portion at a conveyor belt entrance, and wherein the continuous engaging edges of said continuous package spacing ridges of said arcuate portion of the conveyor belt are disposed in rolling operative facing relation with the exterior surface of the forming drum along the length of the arcuate portion.

6. The discharge assembly of claim 5, wherein the conveyor belt retains a plurality of packages within respective package cavities of the plurality of package cavities along the arcuate portion.

7. The discharge assembly of claim 1, comprising:

a base film spool assembly to apply a base film across the plurality of package cavities;

a filling assembly to apply a material to the base film within the plurality of package cavities; and a cap film spool assembly to apply a cap film over the base film at the plurality of package cavities forming a plurality of packages containing the material applied to the base film.

* * * * *